US005400600A

United States Patent [19]

Grenier

[11] Patent Number: 5,400,600

[45] Date of Patent: Mar. 28, 1995

[54] PROCESS AND INSTALLATION FOR THE PRODUCTION OF GASEOUS OXYGEN UNDER PRESSURE

[75] Inventor: Maurice Grenier, Paris, France

[73] Assignee: L'Air Liquide, Societe Anonyme pour l'Etude et l'Exploitation des Procedes Georges Claude, Paris, France

[21] Appl. No.: 72,991

[22] Filed: Jun. 7, 1993

[30] Foreign Application Priority Data

Jun. 23, 1992 [FR] France ..... 92 07662

[51] Int. Cl.[6] ..... F25J 3/02

[52] U.S. Cl. ..... 62/25; 62/38; 62/43

[58] Field of Search ..... 62/39, 25, 38, 44, 22, 62/43

[56] References Cited

U.S. PATENT DOCUMENTS

| | | | |
|---|---|---|---|
| 3,110,155 | 11/1963 | Schuftan | 62/30 |
| 3,414,925 | 11/1965 | Becker | 62/13 |
| 3,447,332 | 6/1969 | Basin et al. | 62/13 |
| 3,648,471 | 3/1972 | Basin et al. | 62/22 |
| 3,760,596 | 9/1973 | Basin et al. | 62/29 |
| 4,303,428 | 12/1981 | Vandenbussche | 62/13 |
| 4,555,256 | 11/1985 | Skolaude et al. | 62/18 |
| 4,883,518 | 11/1989 | Skolaude et al. | 62/38 |
| 5,037,462 | 8/1991 | Schweigert | 62/24 |
| 5,157,926 | 10/1992 | Guilleminot | 62/24 |
| 5,228,296 | 7/1993 | Howard | 62/22 |
| 5,228,297 | 7/1993 | Olson, Jr. et al. | 62/25 |
| 5,237,822 | 8/1993 | Rathbone | 62/25 |

FOREIGN PATENT DOCUMENTS

| | | |
|---|---|---|
| 0024962 | 3/1981 | European Pat. Off. . |
| 0504029 | 9/1992 | European Pat. Off. . |
| 929798 | 6/1962 | United Kingdom . |

*Primary Examiner*—Christopher Kilner
*Attorney, Agent, or Firm*—Young & Thompson

[57] ABSTRACT

Entering air, all of which is compressed to a first high pressure P1, is partly further compressed to a pressure P2. At intermediate temperatures, a portion of each air current is expanded in a turbine (7, 8). One of the turbines can have an output at a pressure P3 comprised between P1 and the medium pressure. The major proportion of the separated oxygen is withdrawn as a liquid from the low pressure column (13), pumped to the production pressure and vaporized in the heat exchange line (2) by condensation or pseudo-condensation of air at one of the pressures P1, P2 and P3, depending on whether the condensation occurs at subcritical or supercritical pressure.

15 Claims, 2 Drawing Sheets

PROCESS AND INSTALLATION FOR THE PRODUCTION OF GASEOUS OXYGEN UNDER PRESSURE

The present invention relates to a process for the production of gaseous oxygen under pressure by distillation of air in an installation comprising a heat exchange line and a double distillation column which itself comprises a first column, so-called medium pressure column, operating under a medium pressure, and a second column, so-called low pressure column, operating under a low pressure, pumping liquid oxygen withdrawn from the base of the low pressure column, and vaporizing the compressed oxygen by heat exchange with compressed air at a high air pressure.

The pressures involved hereinafter are absolute pressures. Moreover, by "condensation" and "vaporization" will be understood either a condensation or a vaporization properly speaking, or a pseudo-condensation or a pseudo-vaporization, according to whether the pressures in question are subcritical or supercritical.

Processes of this type, called "pumping" processes, permit omitting any gaseous oxygen compressor. To obtain an acceptable energy expenditure, it is necessary to compress a large flow of air, of the order of 1.5 times the oxygen flow to be vaporized, to a pressure that is sufficient to permit liquefying the oxygen by countercurrent heat exchange. To do that, the conventional technique uses two compressors in series, the second treating only a fraction of the air adapted to vaporize the liquid oxygen, which substantially increases the capital cost of the installation.

The invention has for its object to provide a process using a single air compressor and having a high overall thermodynamic efficiency.

To this end, the invention has for its object a process of the recited type, characterized in that:

all the air to be treated is compressed to a first high pressure P1 substantially greater than the medium pressure;

a first portion of this air is cooled to a first intermediate temperature T1, at which a first fraction is expanded in a first turbine, while the rest is cooled and liquified, expanded and introduced into the medium pressure column;

the rest of the air at the first high pressure P1 is further compressed to a second high pressure P2 and cooled to a second intermediate temperature T2, at which a first flow is expanded in a second turbin, while the rest of this air is cooled and liquified, expanded and introduced into the medium pressure column;

if desired, the outlet pressure of one of the turbines is adjusted to a pressure P3 comprised between said first high pressure P1 and the medium pressure;

the major portion at least of the separated oxygen is withdrawn in liquid condition from the low pressure column, compressed by a pump to at least a first vaporization pressure at which it is vaporized by condensation of air at one of said high pressures P1, P2 and P3, and is vaporized by condensation of air at this or these pressures.

According to other characteristics:

the intermediate temperatures T1 and T2 are selected so that one is between about 0° C. and −60° C. and the other between about −80° C. and −130° C.;

the air flow rate supplying the warm turbine is of the order of 20 to 30% of the air flow treated;

additional liquid oxygen withdrawn from the low pressure column is compressed by a pump to at least a second vaporization pressure and vaporized at this or these pressures in the heat exchange line;

liquid nitrogen is withdrawn from the double column, compressed by a pump to at least one nitrogen vaporization pressure, and vaporized at this or these pressures in the heat exchange line;

at least a portion of the air from the first or second turbine is expanded to the low pressure in a third turbine, the air from the third turbine being introduced into the low pressure column or into the residual gas evacuated from the upper portion of this column;

all said air from the first or second turbine is expanded in the third turbine, this air being substantially at the medium pressure, as well as a complementary air flow withdrawn from the base of the medium pressure column;

the further compression of the air is effected by means of at least two blowers in series coupled each to one of the turbines.

The invention also has for its object the provision of an installation adapted to practice such a process.

According to a first aspect, this installation, of the type comprising a double air distillation column comprising a column, so-called low pressure column, operating under a low pressure, and a column, so-called medium pressure column, operating under a medium pressure, a pump for the compression of liquid oxygen with,drawn from the base of the low pressure column, compression means to bring the air to be distilled to a high air pressure substantially greater than the medium pressure, and a heat exchange line to place in heat exchange relation the air at the high pressure and the compressed liquid oxygen, is characterized in that the compression means comprise a compressor to bring all the air to be distilled to a first high pressure P1 substantially higher than the medium pressure, and means for further compressing a fraction of the air under this first high pressure to a second high pressure P2, these further compressing means comprising at least two blowers in series each coupled to an expansion turbine, one blower being coupled to one air expansion turbine under the first high pressure P1 and another blower being coupled to a second expansion turbine of a portion of the further compressed air, the heat exchange line comprising cooling passages for the air from the turbine having the highest inlet temperature.

According to a second aspect, the installation according to the invention, of the type comprising a double air distillation column comprising a column, so-called low pressure column, operating under a low pressure, and a column, so-called medium pressure column, operating under a medium pressure, a pump for compressing liquid oxygen withdrawn from the base of the low pressure column, compression means to supply the air to be distilled at a high air pressure substantially greater than the medium pressure, and a heat exchange line to place in heat exchange relation the air at the high pressure and the compressed liquid oxygen, is characterized in that the compression means comprise a compressor to bring all the air to be distilled to a first high pressure substantially greater than the medium pressure, and further compression means for a fraction of the air under this first high pressure to a second high pressure, these further compression means comprising at least two blowers in series each coupled to an expansion turbine, one blower being coupled to one air expansion turbine under the first high pressure P1 and another blower being coupled to a second expansion turbine of a portion of the further compressed air, and in that the inlet temperature T1 of one of the two turbines is comprised between about 0° C. and −60° C., while that T2 of the other turbine is comprised between about −80° C. and −130° C.

Examples of operation of the invention will now be described with respect to the accompanying drawings, in which.

Figure 1:
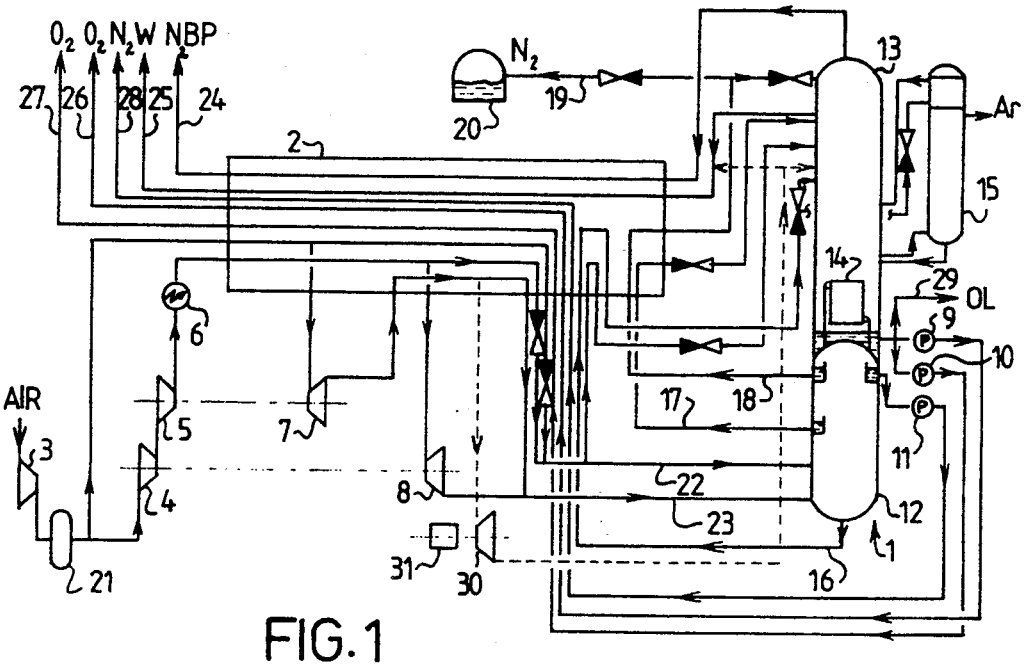
FIG. 1 shows schematically an installation for the production of gaseous oxygen according to the invention.

The installation shown in FIG. 1 is adapted to produce gaseous oxygen under two different pressures, gaseous nitrogen under two different pressures, liquid oxygen and liquid nitrogen.

The installation comprises essentially a double distillation column 1, a heat exchange line 2, a principal air compressor 3, two blowers 4, 5 in series provided at their outlet with a cooler 6, a "warm" turbine 7, a "cold" turbine 8, two liquid oxygen pumps 9, 10 and a liquid nitrogen pump 11.

The double column 1 comprises a medium pressure column operating under 5 to 6 bars, a lower pressure column 13 of the "minaret" type operating a little above atmospheric pressure, a vaporizer-condenser 14 which places the vapor (nitrogen) at the head of column 12 in heat exchange relation with the liquid (oxygen) in the base of the column 13, and an auxiliary column 15 for the production of impure argon coupled to the column 13.

There are provided the conventional conduits 16 for raising "rich liquid" (air enriched in oxygen) from the bottom of column 12 to an intermediate point on column 15 and/or to the head condenser of column 15, 17 for raising "lower poor liquid" (impure nitrogen) from an intermediate point of the column 12 to an intermediate point of the column 13, 18 for raising "upper poor liquid" (pure nitrogen) from the top of column 12 to the top of column 13, the conduits 16, 17 and 18 being each provided with an expansion valve. The liquids carried by these three conduits are subcooled in the cold portion of the heat exchange line 2. A branch 19 of conduit 18, provided with an expansion valve, leads to a liquid nitrogen storage 20.

The rotor of blower 4 is rigidly coupled to that of turbine 8, and, likewise, the rotor of blower 5 is rigidly coupled to that of turbine 7.

In operation, the air to be distilled is compressed in its entirety by the compressor 3 to a pressure P1 of the order of 25 to 35 bars and purified of water and carbon dioxide in an adsorber 21, then divided into two streams.

The first stream, at the pressure P1, is cooled to an intermediate temperature T1 comprised between 0° C. and −60° C. A portion of this first stream undergoes cooling, is liquified, then is expanded to medium pressure in an expansion valve and sent to the column 12 via conduit 22. The rest of the first stream is withdrawn from the heat exchange line at a temperature T1, expanded to the medium pressure in turbine 7, reintroduced into the heat exchange line, cooled and liquified, then sent to the column 12 via conduit 23.

The rest of the air leaving the adsorber 21 is further compressed in two stages by blowers 4 and 5, to a pressure P2 of the order of 35 to 50 bars, precooled at 6, then cooled in the heat exchange line to a second intermediate temperature T2 substantially lower than T1 and comprised between −80° C. and −130° C. A portion of this air undergoes cooling, is liquified, then is expanded to the medium pressure in an expansion valve and introduced into the column 12 via the conduit 22 mentioned above. The rest of the air at pressure P2 is withdrawn from the heat exchange line at temperature T2, expanded to the medium pressure in the turbine 8 and introduced into the column 12 via the mentioned conduit 23.

The cooling of the air is effected by countercurrent circulation, in the heat exchange line 2, of several fluids:

the low pressure gaseous nitrogen from the top of column 13, and the impure or "waste" nitrogen produced by this same column, these two gases flow through the heat exchange line from its cold end to its warm end, then are evacuated via respective conduits 24 and 25.

the greatest portion of the separated oxygen is withdrawn from the base of the column 13 in liquid phase, brought to a relatively low first pressure P01 by the pump 9, vaporized by condensing air either at pressure P1, which corresponds to P01=11 to 17 bars, or at pressure P2, which corresponds to P01=17 to 22 bars, reheated at the ambient temperature then withdrawn as product via a conduit 26;

another portion of the separated oxygen which is desired in this example to be produced in gaseous phase at a second relatively high pressure P02, typically comprised between 11 and 60 bars, is withdrawn from the base of the column 13 in liquid phase, brought to this second pressure P02, vaporized in the heat exchange line by extracting heat from air, without this vaporization being necessarily concomitant to the condensation of this air, then reheated to the ambient temperature and evacuated as product via a conduit 27; and nitrogen, which in this example is desired to be produced in gaseous phase at a pressure of the order of 5 to 60 bars and preferably 25 to 35 bars, is withdrawn in liquid phase from the head of the column 12, brought by the pump 11 to this production pressure, vaporized in the heat exchange line by withdrawal of heat from the air without this vaporization being necessarily concomitant to the condensation of this air, reheated to ambient temperature, and evacuated as product via a conduit 28.

Simultaneously with the production of gaseous oxygen and nitrogen, the installation produces substantial quantities of liquid (oxygen and/or nitrogen). For air at 25 bars at the outlet of compressor 3, the quantity of liquid can reach 40% of the separated oxygen flow rate. There is indicated in FIG. 1, in addition to the, conduit 19 for liquid nitrogen, a conduit 29 for the production of liquid oxygen.

Figure 2:
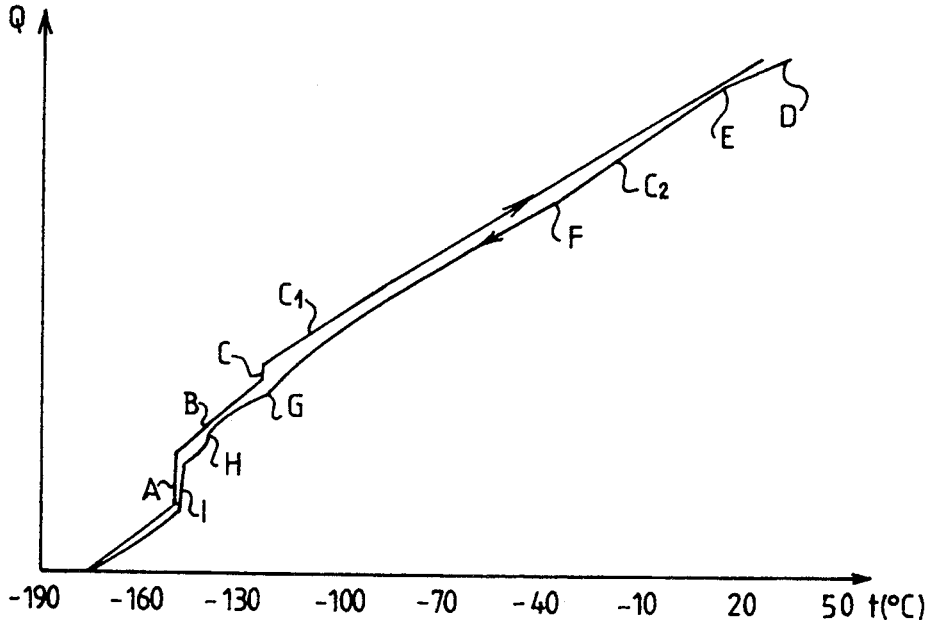
FIG. 2 is a heat exchange diagram, obtained by calculation, corresponding to this installation.

The heat exchange graph of FIG. 2 corresponds to the diagram of FIG. 1 described above, with the following numerical data:

flow rate of treated air: 26,000 $Nm^3/h$

P1=27.5 bars, P2=39.5 bars

T1=−35° C., T2=−122° C.

the production of gaseous oxygen is divided in two thirds at 12 bars (conduit 26) and one third at 42 bars (conduit 27)

the installation produces also 1,600 $Nm^3/h$ of pure gaseous nitrogen at 42 bars (conduit 28), and 1,900 $Nm^3/h$ of liquid.

The heat exchange graph comprises a curve C1 corresponding to the assembly of the reheated fluids, and a curve C2 corresponding to the air treated in the course of cooling.

On curve C1, there will be seen at A the vaporization stage of oxygen at 12 bars, at B a flex point corresponding to the pseudo-stage of nitrogen vaporization under 42 bars, and at C the vaporization stage of oxygen at 42 bars (shorter than the stage A because the flow rate is less).

On curve C2, the point D corresponds to the air inlet at pressure P2, at 32° C., E to the intake air at pressure P1, at 12° C., in which the temperature spread between the curves C2 and C1 is a minimum (2° C.), which is very favorable, F the inlet of turbine 7, which reduces the slope of the curve, G the inlet of the turbine 8, in the vicinity of stage C, which gives rise to an analogous effect, H to the pseudo-stage of condensation of air under pressure P2, in the vicinity of the pseudo-stage B, and I to the elbow representing condensation of air under pressure P1, matching stage A, with a minimum temperature spacing from and about the same length as this stage A.

It will be seen from FIG. 2 that, over all the temperature range covered by the heat exchange line, the two curves are remarkably close, to each other, which corresponds to an overall high thermodynamic efficiency of the process.

As a modification, as shown in broken line in FIG. 1, the installation could comprise a third turbine 30, for example braked by an alternator 31, adapted to expand to the low pressure a portion of the medium pressure air from the turbine 7. As shown, the outlet of the turbine 30 is connected to an intermediate point of the column 13 or to the conduit carrying the residual impure, nitrogen. The inlet of the turbine 30 is at a temperature of about −100° C. to −150° C.

Such a low pressure turbine is interesting in two cases: on the one hand, to valorize the low separation energy when the oxygen is produced at a purity comprised between 85% and 98%, by increasing the production of liquid without substantially decreasing the extraction output of oxygen; on the other hand, to increase the production of liquid to the detriment of that of oxygen. If, as shown, the installation produces argon, it is preferable to send the low pressure air into the impure nitrogen to maintain a good extraction output of argon. In the reverse case, this low pressure air could be blown into the column 13.

Figure 3:
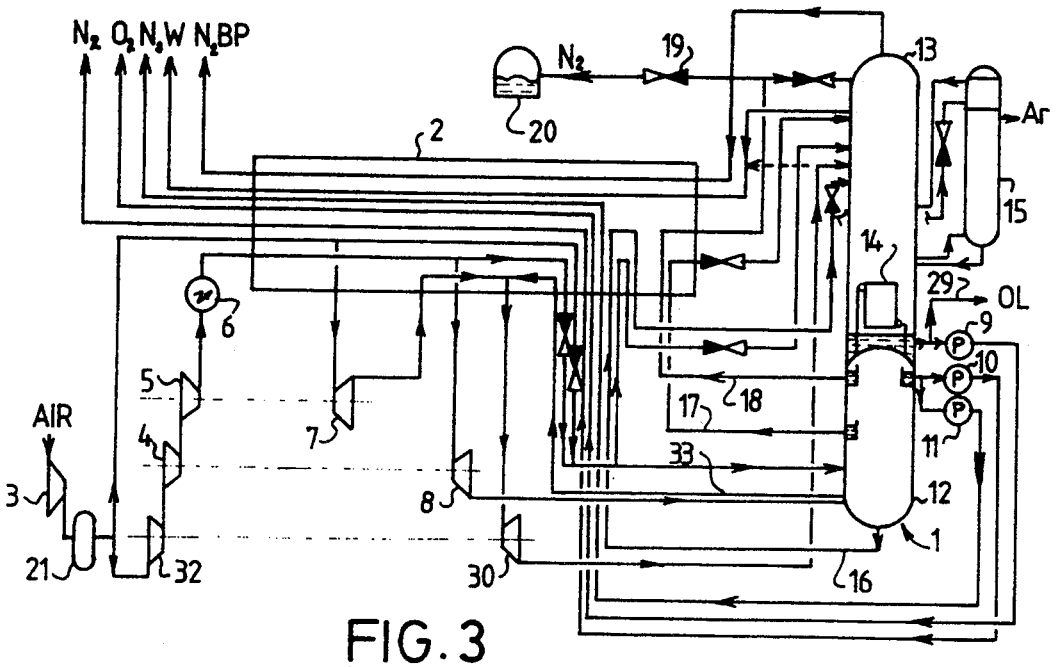
FIGS. 3 and 4 represent schematically two other embodiments of the installation according to the invention.

The installation of FIG. 3 differs from the preceding by the following points:

the low pressure turbine 30 is braked by a third blower 32, whose rotor is rigidly coupled to that of this turbine and which is mounted in series with the blowers 4 and 5, upstream of these latter;

the flow rate to be expanded in the turbine 30 is greater than that expanded in the turbine 7. As a result, the turbine 30 is supplied on the one hand by all of the medium pressure air from the turbine 7, on the other hand by complementary medium pressure air from the column 12 via a conduit 33 and reheated in the heat exchange line to the appropriate temperature;

only the pump 9 is concerned with oxygen, which is therefore produced under a single pressure and entirely vaporized by condensation of air at one of the three available pressures (P1, P2 and the medium pressure), while the pumps 10 and 11 are concerned with nitrogen, which is thus produced under two different pressures and, likewise, vaporized by condensation of air.

Figure 4:
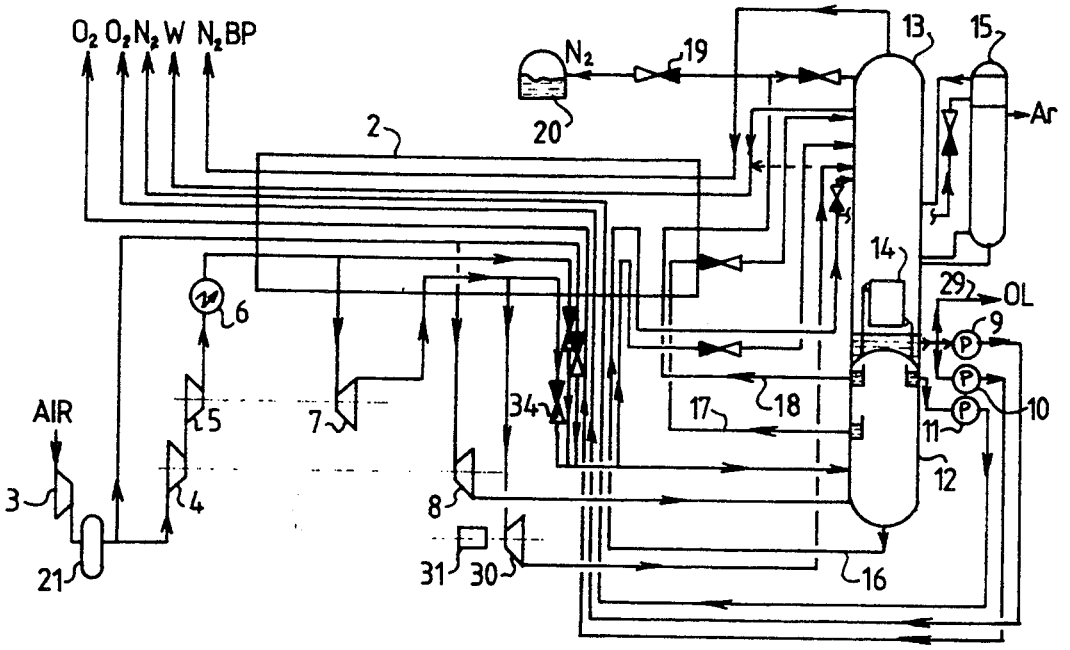

The diagram of FIG. 4 differs from that of FIG. 1 only by the arrangement of the turbines 7 and 8. Thus, it is the "warm" turbine 7 which is supplied with air at the highest pressure P2, while the "cool" turbine 8 is supplied by air at pressure P1. Moreover, the turbine 7 outputs at a pressure P3 greater than the medium pressure and, in practice, comprised between this medium pressure and pressure P1. The air at pressure P3 is cooled and liquified in the heat exchange line, by vaporization of oxygen, then expanded to the medium pressure in an expansion valve 34 before being sent to the column 12. This arrangement is particularly interesting for an oxygen pressure comprised between 3 bars and 8 bars.

In each of the examples described above, the heat exchange line 2 of the installation comprises air cooling passages at three different pressures. One or several of these pressures can be utilized to condense the air by countercurrent vaporization, with a low temperature difference of the order of 2° C., of at least the major portion of the oxygen separated, comprised by liquid phase at a corresponding pressure and vaporized under this pressure of the additional oxygen at another pressure and/or of the nitrogen which can if desired be, moreover, compressed in the liquid phase and vaporized in the heat exchange line 2.

As the pressures P1 and P3 can be chosen as desired, and the pressure P2 adjusted by selecting the air flows to be turbine expanded and the pressure P1, there is enjoyed a great flexibility of choice of vaporization pressures of the oxygen and if desired of the nitrogen. When the principal vaporization of oxygen condenses air at pressure P3, the flow rate of this air can be adjusted to the flow rate of oxygen to be vaporized, which is to say this air flow is adjusted between 20% to 30% of the air flow treated; such a flow rate through the "warm" turbine 7 thus permits remaining in the vicinity of the optimum thermodynamics.

It is to be noted that, as relates to the minor proportion of the oxygen and nitrogen, their vaporization pressures need not be in any way related to the pressures P1, P2 and P3.

Furthermore, the installation produces a fraction of oxygen and of nitrogen in liquid phase with an excellent specific energy by virtue of the utilization of two expansion turbines at very different inlet temperatures.

What is claimed is:

1. In a process for the production of gaseous oxygen under pressure by distillation of air in an installation comprising a heat exchange line (2) and a double distillation column (1) which column comprises a first column (12) operating under a medium pressure and a second column (13) operating under a low pressure, pumping (in 9, 10) liquid oxygen withdrawn from the base of the low pressure column to compress the liquid oxygen, and vaporizing the compressed oxygen by heat exchange with compressed air at a high air pressure; the improvement comprising:

compressing all the air to be treated to a first high pressure P1 substantially greater than said medium pressure;

cooling a first portion of this compressed air to a first intermediate temperature T1, expanding a first fraction of this cooled air in a first turbine (7; 8); and cooling, liquefying, expanding and introducing into medium pressure column (12) the rest of this cooled air;

further compressing the rest of the air at the first high pressure P1 to a second high pressure P2 greater than P1 and cooling this further compressed air to a second intermediate temperature T2; expanding a first flow of this air at temperature T2 in a second turbine (8; 7); and liquifying, expanding and introducing into the medium pressure column (12) the rest of this air that was cooled to temperature T2;

withdrawing the major portion of at least the separated oxygen in liquid phase from the low pressure column (13); compressing the liquid oxygen by pumping to at least one first vaporization pressure at which it vaporizes by heat exchange with air at at least one of said high pressures P1 and P2 thereby to condensate air at said at least one high pressure.

2. Process according to claim 1, wherein the intermediate temperatures T1 and T2 are one between about 0° C. and −60° C. and the other between about −80° C. and −130° C.

3. Process according to claim 1, wherein the air flow supplying the first turbine (7; 8) is of the order of 20 to 30% of the air flow treated.

4. Process according to claim 1, and withdrawing additional liquid oxygen from the low pressure column (13) and compressing the same by pumping to at least one second vaporization pressure and vaporizing the same at the last-mentioned pressure in heat exchange with air.

5. Process according to claim 1, and withdrawing liquid nitrogen from the double column (1), compressing the same by pumping (10, 11) to at least one nitrogen vaporization pressure, and vaporizing the same at the last-mentioned pressure by heat exchange with air.

6. Process according to claim 1, and at least a portion of the air from the first or the second turbine (7, 8) to the low pressure in a third turbine (30), and introducing the air from the third turbine into the low pressure column (13) or in 5 the residual gas evacuated from an upper portion of the low pressure column (13).

7. Process according to claim 6, wherein all said air from the first or the second turbine (7, 8) is expanded in the third turbine (30), this air being at substantially the medium pressure, as well as a complementary air flow withdrawn from the base of the medium pressure column (12).

8. Process according to claim 1, wherein the further compression of the air is effected by means of at least two blowers (4, 5, 32) in series each coupled to one of the turbines (7, 8, 30).

9. In an installation for the production of gaseous oxygen under pressure by the distillation of air in a double air distillation column (1) comprising a column (13) operating under a low pressure and a column (12) operating under a medium pressure, a pump (9, 10) for compressing liquid oxygen withdrawn from the base of the low pressure column (13), compression means (3, 4, 5, 32) to bring the air to be distilled to a high air pressure substantially greater than the medium pressure, and a heat exchange line (2) to place in heat exchange relation the air at the high pressure and the compressed liquid oxygen; the improvement wherein the compression means comprise a compressor (3) to bring all the air to be distilled to a first high pressure P1 substantially greater than the medium pressure, and means (4, 5, 32) for further compressing a fraction of the air under this first high pressure to a second high pressure P2, these further compression means comprising at least two blowers in series each coupled to an expansion turbine (7, 8, 30), one said blower (4; 5) being coupled to a said turbine (7; 8) for expanding air under the first high pressure P1 and another said blower (5; 4) being coupled to a second said turbine (8; 7) for expanding a portion of the further compressed air, the heat exchange line (2) comprising cooling passages for air from the said turbine (7) having the higher inlet temperature, and means for passing air from said turbine (7) having the higher inlet temperature through said cooling passages in countercurrent heat exchange relation with said compressed oxygen.

10. Installation according to claim 9, wherein the inlet temperature T1 for one (7) of the two turbines is comprised between about 0° C. and −60° C., while the inlet temperature T2 of the other turbine (8) is comprised between about −80° C. and −130° C.

11. Installation according to claim 9, which further comprises a second pump (10) for liquid oxygen or liquid nitrogen, the heat exchange line (2) comprising passages for vaporization-reheating of liquid thus pumped.

12. Installation according to claim 9, which further comprises a third turbine (3(:)) for expanding to the low pressure at least a portion of the air from the said turbine (7) having the higher inlet temperature, and means to introduce the air from the third turbine into the low pressure column (13) or into a residual gas conduit from the low pressure column (13).

13. Installation according to claim 12, which further comprises means (33) to complete the supply of the third turbine (30) with air withdrawn from the base of the medium pressure column (12), said air from said turbine (7) having the higher inlet temperature being substantially at the medium pressure.

14. In an installation for the production of gaseous oxygen under pressure by distillation of air in a double air distillation column (1) comprising a column (13) operating under a low pressure and a column (12) operating under a medium pressure, a pump (9, 10) for compressing liquid oxygen withdrawn from the base of the low pressure column (13), compression means (3, 4, 5, 32) to supply air to be distilled at a high air pressure substantially greater than the medium pressure, and a heat exchange line (2) to place in heat exchange relation the air at the high pressure and the compressed liquid oxygen; the improvement wherein the compression means comprise a compressor (3) to bring all the air to be distilled to a first high pressure P1 substantially greater than the medium pressure, and means (4, 5, 32) for further compressing a fraction of the air under this first high pressure to a second high pressure P2, these further compression means comprising at least two blowers in series each coupled to an .expansion turbine (7, 8, 32), one said blower (4; 5) being coupled to one turbine (7; 8) for expanding air under the first high pressure P1 and another said blower (5; 4) being coupled to a second turbine (8; 7) for expansion of a portion of the further compressed air, the inlet temperature T1 of one (7) of the two turbines being between about 0° C. and −60° C., while the inlet temperature T2 of the other turbine (8) is between about −80° C. and −130° C., the outlet pressure of said one turbine (7) being a pressure of said column (1) and means for passing air directly to said column (1) from said one turbine (7).

15. Installation according to claim 14, wherein the heat exchange line (2) comprises cooling passages for air from the turbine (7) having the higher inlet temperature, and means for passing air from said turbine (7) having the higher inlet temperature through said cooling passages in countercurrent heat exchange relation with said compressed oxygen.

* * * * *